US005248982A

United States Patent [19]

Reinhardt et al.

[11] Patent Number: 5,248,982

[45] Date of Patent: Sep. 28, 1993

[54] METHOD AND APPARATUS FOR CALIBRATING PHASED ARRAY RECEIVING ANTENNAS

[75] Inventors: Victor S. Reinhardt, Rancho Palos Verdes; Arnold L. Berman, Los Angeles, both of Calif.

[73] Assignee: Hughes Aircraft Company, Los Angeles, Calif.

[21] Appl. No.: 914,187

[22] Filed: Jul. 15, 1992

Related U.S. Application Data

[63] Continuation-in-part of Ser. No. 751,852, Aug. 29, 1991, abandoned.

[51] Int. Cl.[5] ..... H01Q 3/22

[52] U.S. Cl. ..... 342/375; 342/377; 342/174

[58] Field of Search ..... 342/174, 369, 375, 371, 342/372, 377

[56] References Cited

U.S. PATENT DOCUMENTS 4,994,810 2/1991 Sinsky ..... 342/174
5,027,127 6/1991 Shnitken et al. ..... 342/372
5,063,127 11/1991 Chapoton ..... 342/174
5,111,208 5/1992 Lopez ..... 342/174

OTHER PUBLICATIONS

Steyskal et al., "Digital Beamforming for Radar Systems", Microwave Journal, Jan. 1989.
Herd "Experimental Results of a Self Calibrating Digital Beamforming Array IEEE", 1990.

*Primary Examiner*—Gregory C. Issing
*Attorney, Agent, or Firm*—William J. Streeter; Wanda K. Denson-Low

[57] ABSTRACT

Disclosed is a method and apparatus for calibrating phased array receiving antennas that includes circuitry for generating a pair of calibration signals separable one from the other. The signals are injected into the delay elements of the antenna from opposite ends of a complementary calibration cable. The delay produced in the calibration signals is individually measured, and the delays summed and averaged to produce a delay measurement independent of delays produced by the calibration cable and accordingly delay measurement variations caused by environmental effects on the calibration cable.

17 Claims, 3 Drawing Sheets

METHOD AND APPARATUS FOR CALIBRATING PHASED ARRAY RECEIVING ANTENNAS

CROSS REFERENCE TO RELATED APPLICATIONS

This application is a continuation in part of U.S. patent application Ser. No. 07/751,852, filed Aug. 29, 1991, now abandoned.

BACKGROUND

The present invention relates to antennas and, more particularly, to receive phased array antennas.

A phased array receiving antenna is comprised of an array of individual antenna and electronic phase shifter elements typically arranged in a planar array that is adapted to receive an electromagnetic signal. Adjusting the phase shift and/or delay of a received signal through each of the antenna and delay elements and summing the signals enables the antenna to be electronically steered. Accurate electronic steering of the antenna requires that the relative phase shift and/or delay through each of the antenna and delay elements be accurately known and adjusted. In narrow band phased array receiving antennas it is important that the signals be in-phase when they are summed. In wide band phased array antennas, both the phase and group delay of the received signals must be the same.

In severe temperature environments, encountered in arctic and space environments, for example, it is difficult to maintain the phase accuracy of the elements without calibration. Existing calibration systems use a calibrated beacon to transmit a calibration signal to the array, or transmit a calibration signal in one direction down a distribution cable to the inputs of each antenna and delay element of the antenna array. The relative phase and/or delay of this calibration signal through the antenna and delay elements is measured at the outputs of each of the delay elements to determine the phase shift and/or delay through each element. In both the beacon and the distribution cable calibration methods, it is necessary to know the relative phases and/or delays of the calibration signal at the inputs of each antenna and delay element to perform an accurate calibration. Any uncertainties or unknown changes in these relative phases and/or delays produce errors in the calibration measurement and adjustment period.

One conventional antenna calibration system is described in a brief technical paper entitled "Experimental Results From a Self-Calibrating Digital Beamforming Array," by Jeffrey Herd. This paper describes a self-calibrating linear array comprising 32 elemental receivers and a digital beamforming processor which can output 32 custom beams. This system includes a self-calibration system that comprises a calibration source and a calibration feed that is coupled to the receivers. The calibration system uses a closed loop feed network, and the calibration source has two paths to each elemental receiver port. The outputs from the receiver are measured with the test signal fed successively from each side of the loop. Variations in the phase shift and attenuation of the test signal due to the calibration feed cancel out when the measured outputs from both directions are combined. The antenna calibration system referred to above is also described in a technical report entitled "Digital Beamsteering Antenna", by Louis Eber submitted to the Air Force under contract. The report is available from the National Technical Information Service (NTIS) as Rome Air Development Center Technical Report RADC-88-83, June 1988, NTIS No. A200030.

It is therefore an objective of the present invention to provide an improved method and apparatus for calibrating phased array receiving antennas. Another objective of the invention is to provide a method and apparatus for calibrating phased array receiving antennas using a pair of calibration signals to reduce calibration errors. Still another objective of the invention is to provide a method and apparatus for calibrating phased array receiving antennas using a pair of calibration signals applied to the elements of a phased array receiving antenna from opposite ends of a calibration cable connected to the elements. Still another objective of the present invention is to provide a method and apparatus for calibrating phased array receiving antennas which uses a pair of calibration signals of closely displaced frequency and applied to the inputs of the elements of the antenna array from opposite ends of a calibration cable. Another objective of the invention is to provide a method and apparatus for calibrating phased array antennas that is applicable to both narrow band and wide band phased array receiving antennas. Yet another objective of the invention is to provide a method and apparatus for calibrating phased array receiving antennas using a pair of calibration signals of different frequency applied to the inputs of the individual elements of the antenna array from opposite ends of a complementary cable connected to the inputs of the elements of the antenna array.

SUMMARY OF THE INVENTION

Broadly, the invention is a calibrator for calibrating phased array antennas that include a plurality of individual receiving and phase shift or delay elements. The calibrator includes means for generating first and second separable calibration signals and means including a calibration cable having opposite ends connected to the calibration signal generating means and to the inputs of each of the antenna array receiving elements. Means are provided for measuring the phase shift or delay of the first and second calibration signals at the outputs of each of the antenna delay element outputs and for averaging the phase shift or delays of the first and second calibration signals to eliminate phase shift or delays in the calibration of signals occurring in the calibration cable.

In a specific embodiment of the invention, a first calibration signal has a frequency slightly displaced from the frequency of a second calibration signal. The first and second calibration signals are applied at opposite ends of a complementary calibration cable. The complementary cable is a reciprocal line for the two frequencies. In another specific embodiment of the invention, the first and second calibration signals are orthogonal spread spectrum signals.

In accordance with the method of the invention, first and second separable calibration signals are applied from opposite ends of a calibration cable to the individual elements of a phased array receiving antenna. The relative phase shift or delays in the first and second calibration signals are measured at the output of the phased array antenna, summed, and averaged to eliminate variations in the measurement occasioned by phase shifts or delays caused by the calibration cable. The first and second calibration signals may be a pair of signals closely spaced in frequency, or may be orthogonal spread spectrum signals.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
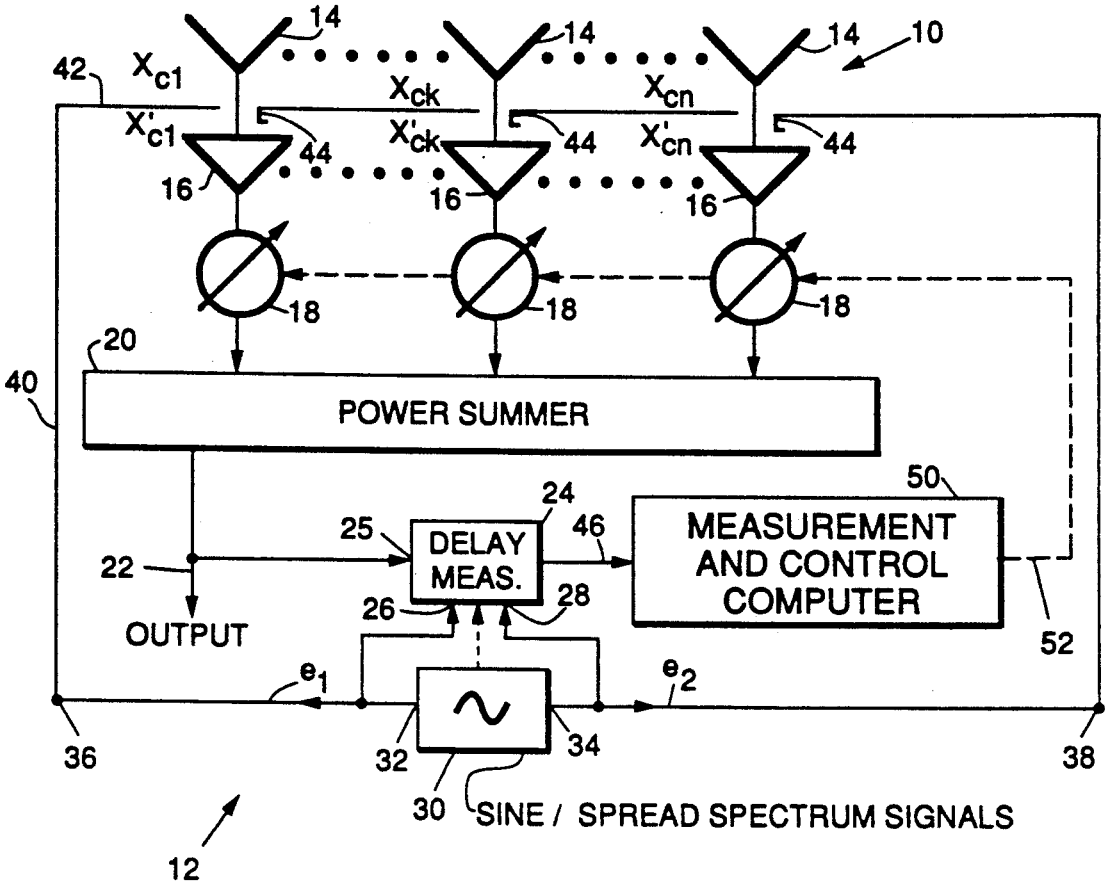
FIG. 1 is a schematic diagram in block form of an exemplary embodiment of the calibrator of the present invention using either frequency displaced or orthogonal spread spectrum calibration signals.

FIG. 1 shows a phased array receiving antenna 10 connected to a calibrator 12 of the present invention. The antenna 10 typically comprises a multiplicity of antenna elements 14 each having its output connected to a respective amplifier element 16. The outputs of the amplifier elements 16 are connected through a phase delay adjustment device 18, summed together in a power summer 20 whose output is applied to the input of a receiving system (not shown in the figure).

The calibrator 12 includes a phase shift or delay measurement apparatus 24. The apparatus 24 has a pair of inputs 26, 28 connected to receive individual ones of a pair of calibration signals $e_1$, $e_2$ and an input 25 from the power summer 20. The calibration signals $e_1$, $e_2$, in one embodiment of the invention, comprise a pair of sine wave signals of slightly different frequency, the frequencies being close to the operating frequency for which the antenna is designed. The frequency differential between the calibration signals $e_1$, $e_2$ is selected to enable these two signals to be distinguished or separated one from the other using conventional signal separating means. The two calibration signals $e_1$, $e_2$ are generated by a suitable calibration signal generating means 30 having a pair of outputs 32, 34 connected to opposite ends 36, 38 of a calibration cable means 40. The calibration cable means 40 comprises series connected calibration cables 42 each provided with a calibration signal injecting means 44 connected to the input of each antenna element 14. A dashed line is shown connected between the apparatus and the calibration signal generating means 30 which is employed when spread spectrum signals are used, as will be described with reference to FIGS. 4 and 5.

The output 46 of the delay or phase measuring apparatus 24 is comprised of two phase difference or delay measurements, each between the two calibrating signals 26, 28 and the same signals as present at the output of the phased array antenna 22. These phase difference or delay measurements are applied to the input of the measurement and control computer 50 which functions as follows. During calibration, the computer 50 first averages the two phase difference or delay measurements to produce a single average measurement. The computer then either changes the phase or delay of a single phase shift or delay element 18 and either (1) measures the change in the average phase difference or delay output, or (2) turns all the elements off except a single element via control line 52, to generate an average phase difference or delay calibration measurement for that element. The computer 50 finally stores these calibration measurements in a look-up table for use as calibration corrections during normal operation of the antenna.

Figure 2:
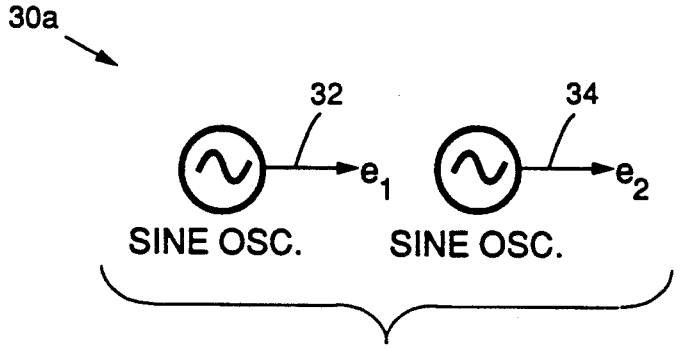
FIG. 2 shows an implementation of sine generators for use in the calibrator of FIG. 1 for producing sine outputs $e_1$ and $e_2$.

FIG. 2 shows one implementation of sine generators **30*a* comprising the signal generating means 30 for producing sine outputs $e_1$ and $e_2$. Such sine generators 30*a* are utilized when measuring phase differences. It is comprised of two RF oscillators or frequency synthesizers each producing sine outputs $e_1$ and $e_2$ at frequency $f_1$ and $f_2$, respectively. RF oscillators or frequency synthesizers for implementing the sine generators 30*a*** are well known in the art.

Figure 3:
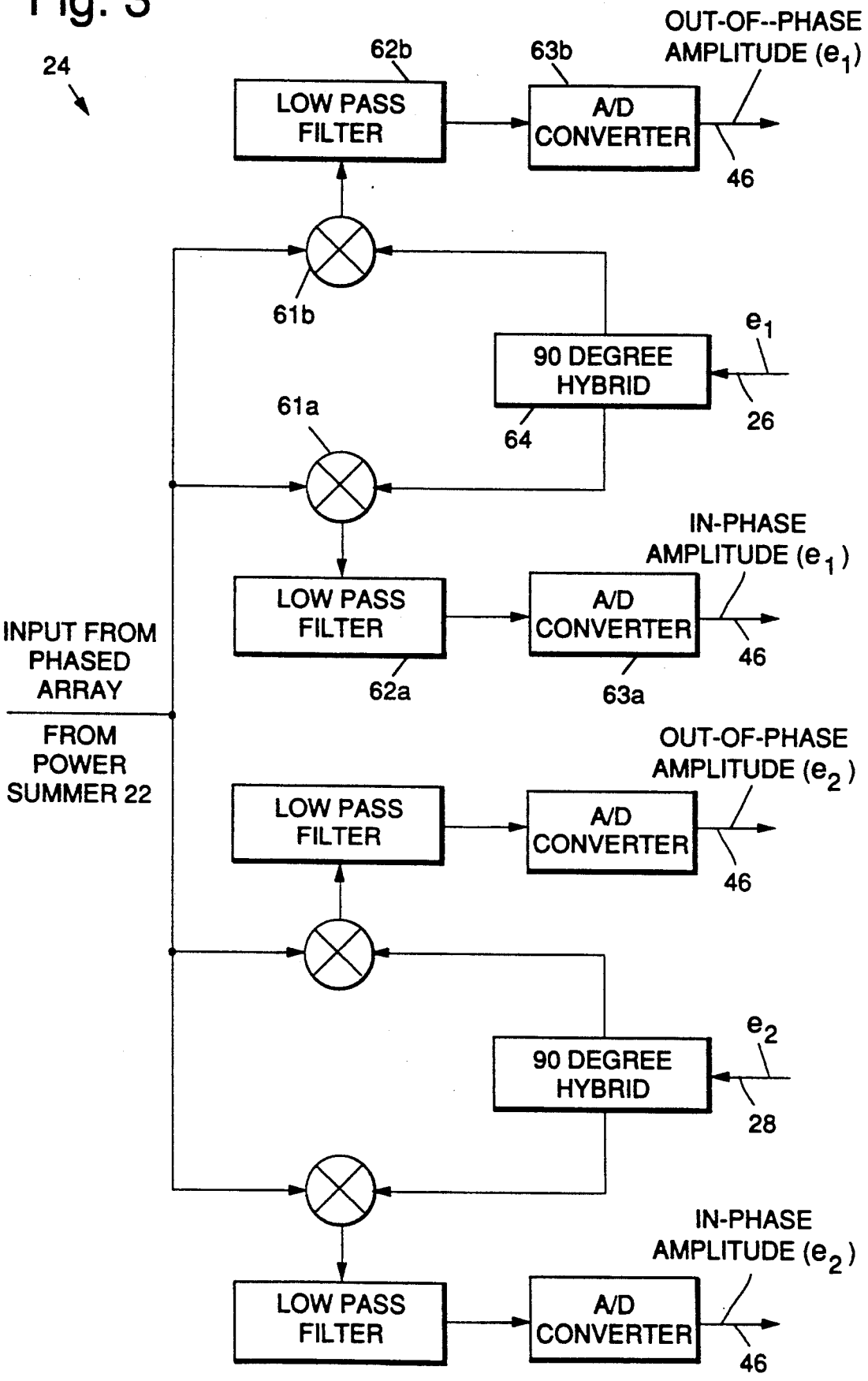
FIG. 3 shows an implementation of phase difference measuring apparatus for use with the sine output generators shown in FIG. 2.

FIG. 3 shows one implementation of the phase difference measuring version of the apparatus 24, for use with the sine output generators **30*a* shown in FIG. 2. In this apparatus 24, the signal from the phased array 22 is applied to in-phase and out-of-phase mixers 61*a*, 61*b*. The signal $e_1$ generated by the sine generator 30*a* is applied to the first input 26 of the apparatus 24. In-phase and out-of-phase versions of $e_1$ are generated by a 90 degree hybrid 64. The signal from the phased array 22 is mixed in the in-phase and out-of-phase mixers 61*a*, 61*b* with the in-phase and out-of-phase (90 degree phase shifted) versions of $e_1$ the reference signal at frequency $f_1$. This produces DC signals at the outputs of the in-phase and out-of-phase mixers 61*a*, 61*b*. These DC signals are then low pass filtered in filters 62*a*, 62*b* to remove the unwanted signal at $f_2$ and digitized using analog to digital converters (A/D converters) 63*a*, 63*b* to produce in-phase and out-of-phase amplitudes comprising the output 46 of the apparatus 24. A similar circuit also produces digitized in-phase and out-of-phase amplitudes from $e_2$, the reference signal at frequency $f_2$ applied to input 28**. The frequencies $f_1$ and $f_2$ are chosen to be far enough apart so that the low pass filters can easily separate the $e_1$ and $e_2$ components. The digitized in-phase and out-of-phase differences for $e_1$ and $e_2$ are generated by taking the inverse tangent of the ratio of the out-of-phase and in-phase amplitudes. The in-phase and out-of-phase amplitudes can also be utilized to generate amplitude calibration signals, which are also useful in calibrating the antenna. All of the components and techniques utilized in the circuit of FIG. 3 are well known in the art.

Figure 4:
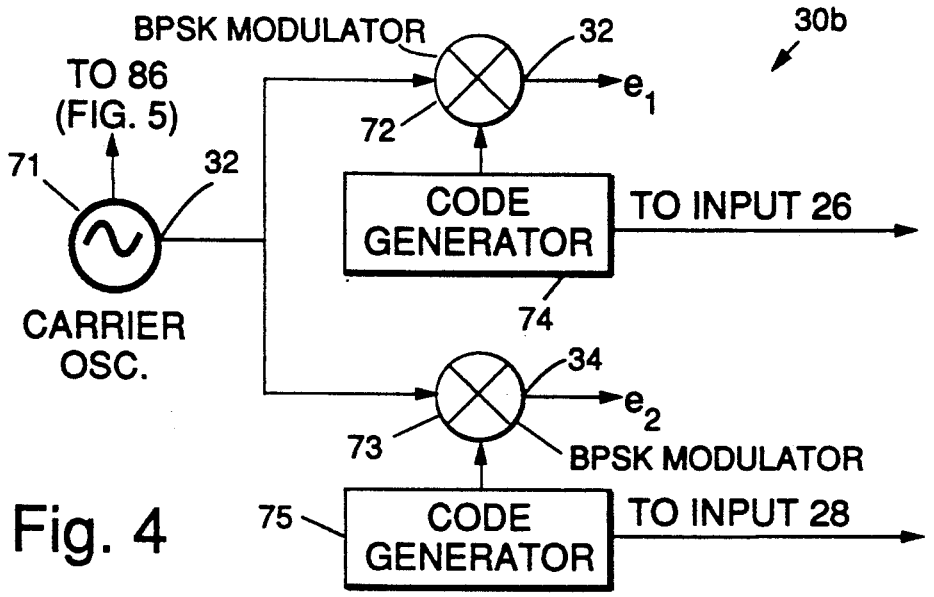
FIG. 4 shows an implementation of a spread spectrum generator that is utilized when measuring delay differences.

FIG. 4 shows one implementation of a spread spectrum generator **30*b*, which is utilized when measuring delay differences. An RF carrier oscillator 71 supplies an RF carrier (by way of the dashed line in FIG. 1) to two binary phase shift keyed (BPSK) modulators 72, 73, which may be fabricated using double balanced mixers. Modulation signals are produced by two digital pseudorandom or maximal length code generators 74, 75, which may be comprised of shift registers and exclusive OR gates, and which generate orthogonal codes Code 1 and Code 2, respectively. Thus the two BPSK modulators 72, 73** produce spread spectrum BPSK RF signals $e_1$ and $e_2$. All the components and techniques utilized for this spread spectrum generator are well known in the art.

Figure 5:
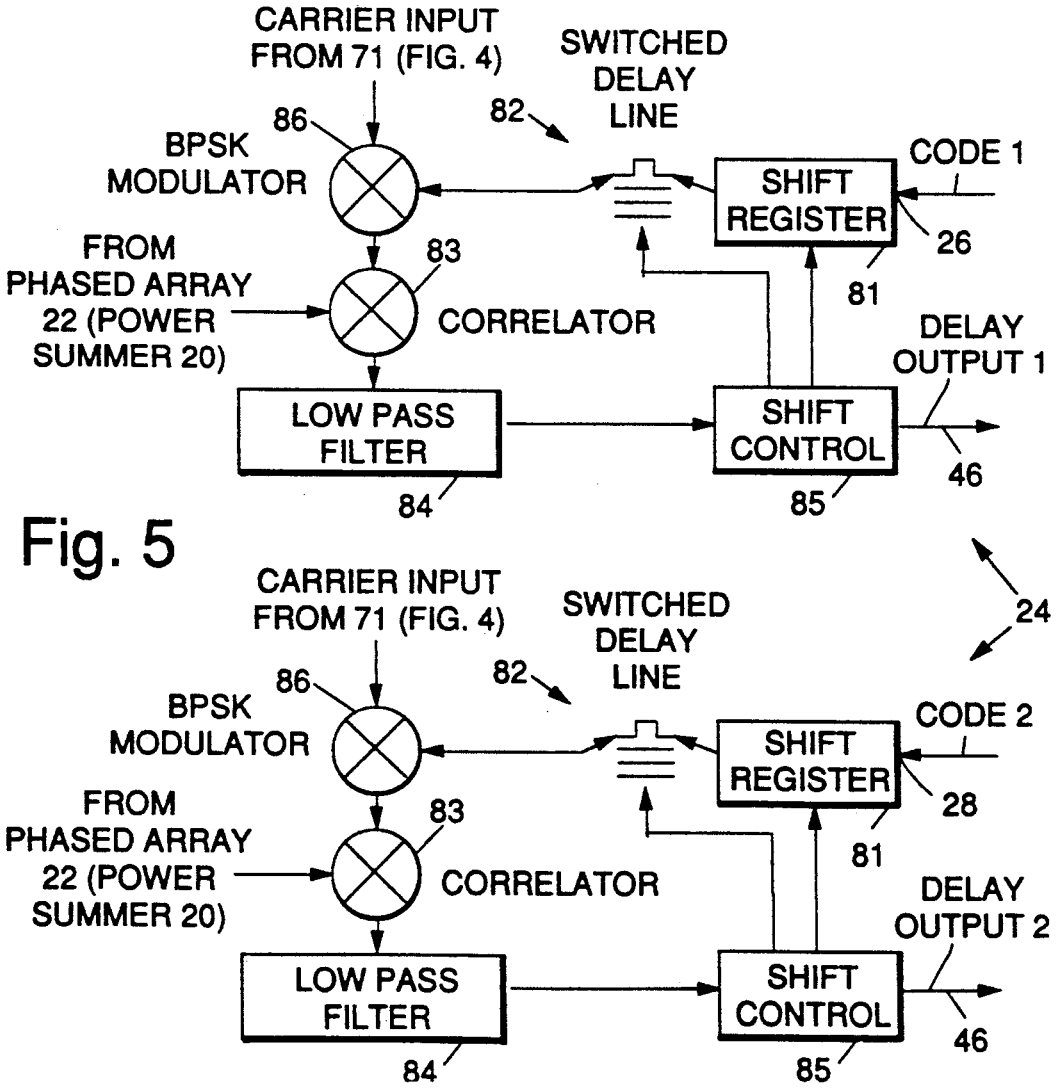
FIG. 5 shows an implementation of the delay measurement apparatus employed in the present invention.

FIG. 5 shows one implementation of the delay measurement apparatus 24. FIG. 5 is duplicated to produce delay measurements for both $e_1$ and $e_2$. Here, spread spectrum BPSK modulated RF signals are regenerated for Code 1 or Code 2 with delayed versions of the original codes supplied by the spread spectrum generator 30*b*. The coarse delay is produced by passing the codes through a shift register 81, that delays the codes a specified number of bits. The fine delay is produced by a switched delay line 82, that delays the codes fractions of a bit up to one bit. The delayed spread spectrum signals are then mixed with the carrier output signals from the carrier oscillator 71 (FIG. 4) in a modulator 86 and are then correlated in a correlator 83 (mixer) with the signal from the phased array 22 to produce a DC correlation output. The DC correlation output is then low pass filtered in a filter 84 and applied to a shift control circuit 85. The shift control circuit 85 then measures this DC output while changing the delay introduced by the shift registers 81 and switched delay lines 82 until maximum correlation is produced. Maximum correlation occurs when the delay in the shift register 81 matches the delayed output from the phased array antenna 10. These delay values are then sent to the computer 50. All the components and techniques utilized for this spread spectrum generator are generally well known in the prior art.

The signals $e_1$, $e_2$ propagate in opposite directions through the calibration cable 42 and are injected into inputs of the antenna receiving elements 14. These signals pass through the receiving elements 14, amplifier elements 16, and phase or delay adjusting elements 18, through the power summer 20 and then through the phase difference or delay measurement apparatus 24. The total phase shift or delay imparted to the signals $e_1$, $e_2$ will comprise the phase shift or delay caused by the complementary calibration cable 42 plus the phase shift or delay imposed by the antenna, amplifier, and adjusting elements 14, 16, 18. This can be represented mathematically for the kth element, as:

$$X_k = X_{ek} + X_{ck},$$

and $$X'_k = X'_{ek} + X'_{ck},$$

where $X_k$ is the total delay occurring in the calibration signal produced by the delay of the calibration cable $X_{ck}$ and the phase shift or delay $X_{ek}$ imposed by the antenna, amplifier, and adjusting elements 14, 16, 18, respectively, for signal $e_1$, and where $X'_k + X'_{ek}$, $X'_{ck}$ similarly apply for signal $e_2$.

If the complementary calibration cable 42 is a reciprocal line for the two frequencies $f_c$ and $f'_c$, that is, a cable for which the propagation delay is the same in both directions, then: $X'_{ck} = A - X_{ck}$. For any set of conditions, A is a constant. Accordingly, the delay through any combination of an antenna element, amplifier element, and adjusting element 14, 16, 18 measured using signal $e_1$ and also measured using calibration signal $e_2$ can be determined as the sum of the two delays, or:

$$X_k + X'_k = X_{ck} + X_{ek} + X'_{ck} X'_{ek}.$$

Substituting yields:

$$(X_k + X'_k)/2 = (X_{ek} + X'_{ek})/2 + A/2.$$

It will now be observed that using the calibrator 12 of the present invention, the average delay through each group of elements 14, 16, 18 $(X_{ek} + X'_{ek})/2$ is measured independent of the delay occasioned by the calibration cable means 40. Since only the relative element to element values of $X_k$ are important for aligning the antenna, the constant A/2 is of no significance.

For the case where the phase shift is controlled by the delay adjustment devices 18 and measured at the delay measurement apparatus 24, the (phase) delay is related to the phase shift by:

$$X = \phi / f_0$$

where X is the delay, f is the phase shift, and $\phi_0$ is either frequency $f_c$ or $f_c'$. By utilizing this formula, one can similarly show that the averaging algorithm is given by:

$$\phi_{ek} = (f_c' \phi_k + f_c \phi_k')/(f_c' + f_c) + \text{constant}$$

where $\phi_{ek}$ is the phase shift for element k at $f_c$, and where $\phi_k$ and $\phi_k'$ are the measured phase shifts. Here it is assumed that $f_c$ and $f_c'$ are close enough in frequency that the delay through element k and the calibration cable is the same for both frequencies.

From the above description, it will be noted that the invention comprises a method as well as apparatus for calibrating phased array receiving antennas. The steps of the method comprise: injecting a pair of separable calibration signals into the inputs of the receiving elements of a phased array receiving antenna from ends of a complementary calibration cable; and measuring, and averaging the phase shift or delay in the calibration signals to produce a phase shift or delay measurement that is independent or delays occasioned by the complementary calibration cable.

Thus there have been described a new and improved method and apparatus for calibrating phased array receiving antennas. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A calibrator for calibrating phased array antennas which include a plurality of individual antenna receiving and delay elements, the calibrator comprising:

calibration signal generating means for generating first and second separable calibration signals;

calibration cable means including a calibration signal cable having opposite ends connected to respective outputs of the calibration signal generating means for receiving respective ones of the first and second calibration signals;

calibration signal injecting means connecting the calibration signal cable to inputs of each of the antenna receiving elements;

power summing means coupled to outputs of the antenna delay elements;

delay measurement means coupled to the calibration signal generating means and to the power summing means for measuring calibration signal delays or phase shifts of the first and second calibration signals at outputs of each of the antenna delay elements; and computer means coupled between the delay measurement means and the antenna delay elements for summing and averaging the measured signal delays or phase shifts in the first and second calibration signals, and for adjusting the signal delays or phase shifts of selected antenna delay elements in response thereto.

2. The calibrator of claim 1 wherein the calibration cable is a complementary calibration cable.

3. The calibrator of claim 2 wherein the delay in the first and second calibration signals produced by propagation of the calibration signals over the length of the calibration cable is A, the delay caused by the calibration cable in the calibration signal propagating from the calibration signal generating means to an antenna element k is $X_k$, and the delay in the first and second calibration signals arriving at the antenna element is $A-X_k$.

4. The calibrator of claim 1 wherein the first and second calibration signals are sine wave signals of different closely spaced frequencies.

5. The calibrator of claim 1 wherein the first and second calibration signals are spread spectrum signals having orthogonal codes.

6. The calibrator of claim 5 wherein the computer means further comprises, means for applying a smoothing algorithm to the measured phase shifts of the first and second calibration signals for eliminating phase ambiguities therebetween.

7. The calibrator of claim 1 wherein the first and second calibration signals are two simultaneously occurring calibration signals of differing calibration signal frequencies transmitted in opposite directions to said plurality of antenna receiving elements.

8. The calibrator of claim 3 wherein the computer means is adapted to measure and compute the average delay of the first and second calibration signals caused by each antenna element in accordance with the relationship $(x_k+x'_k)/2=(x_{ek}+x'_{ek})/2+A/2$, where $X_{ek}$ is the delay in the first calibration signal produced by a delay element k and $X'_{ek}$ is the delay in the second calibration signal produced by a delay element k.

9. The calibrator of claim 3 wherein the computer means is adapted to measure and compute the average phase shift between the first and second calibration signals caused by each antenna element in accordance with the relationship $\phi_{ek}=(f_c'\phi_k+f_c\phi_k')/(f_c'+f_c)+$constant, where $\phi_{ek}$ is the phase shift for element k at $f_c$, $f_c$ and $f_c'$ are frequencies, and where $\phi_k$ and $\phi_k'$ are the measured phase shifts.

10. The calibrator of claim 1 wherein the delay elements are analog delay elements.

11. The calibrator of claim 1 wherein the delay elements are digital delay elements.

12. A method for calibrating a phased array receiving antenna which includes an array of individual antenna receiving elements and delay elements, comprising the steps of:

injecting first and second separable calibration signals into each of the delay elements of the antenna through opposite ends of a complementary calibration cable connected to the inputs thereof;

measuring the delay in the first calibration signal produced by a delay element k;

measuring the delay in the second calibration signal produced by a delay element k;

summing and averaging a delay in the first and second calibration signals to generate an average delay produced by the delay element independent of the delay produced therein by the calibration cable.

13. The method of claim 12 wherein the first and second calibration signals are sine wave signals of different closely spaced frequencies.

14. The method of claim 13 wherein the frequency of the calibration signals is at or near the operating frequency of the phased array antenna.

15. The method of claim 12 wherein the first and second calibration signals are orthogonally coded spread spectrum signals.

16. The calibrator of claim 15 wherein the carrier frequency of the spread spectrum signals are of different frequencies at or near the center operating frequency of the phased array antenna.

17. The method of claim 12 wherein the first and second calibration signals are two simultaneously occurring calibration signals having different frequencies in the operating frequency range of the phased array antenna and being transmitted in opposite directions to said array of individual antenna receiving elements.

* * * * *